US006215850B1

(12) United States Patent
Blake et al.

(10) Patent No.: US 6,215,850 B1
(45) Date of Patent: Apr. 10, 2001

(54) X-RAY BEAM CONTROL FOR AN IMAGING SYSTEM

(75) Inventors: James A. Blake, Franklin; Jonathan R. Schmidt, Wales; Alexander M. Blok, Milwaukee, all of WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/218,347

(22) Filed: Dec. 22, 1998

(51) Int. Cl.[7] ..... H05G 1/06
(52) U.S. Cl. ..... 378/114; 378/101; 378/111
(58) Field of Search ..... 378/101, 109, 378/110, 111, 112, 114, 62

(56) References Cited

U.S. PATENT DOCUMENTS 5,077,771 * 12/1991 Skillcorn et al. ..... 378/104
5,495,165 * 2/1996 Beland ..... 378/111

* cited by examiner

*Primary Examiner*—Robert H. Kim
*Assistant Examiner*—Drew A. Dunn
(74) *Attorney, Agent, or Firm*—Armstrong Teasdale LLP; Christian G. Cabou

(57) ABSTRACT

The present invention, in one form, includes methods and apparatus for reducing the x-ray dosage to a patient in a medical imaging system. In accordance with one embodiment of the present invention, a switching unit, or circuit, is coupled to a x-ray tube and a power supply to control the emission of x-ray beams from the x-ray tube. The switching unit is configured to alter a voltage and current signal applied to the x-ray tube control grid so that the magnitude of the x-ray beams is modified, or altered. By utilizing the switching unit the patient x-ray dosage is reduced and the magnitude of the x-ray beams may be configured to match the requirements of the application.

27 Claims, 5 Drawing Sheets

X-RAY BEAM CONTROL FOR AN IMAGING SYSTEM

BACKGROUND OF THE INVENTION

This invention relates generally to x-ray tubes used in imaging systems and more particularly, to a switching unit to control the duration and magnitude of x-ray beams transmitted from an x-ray tube.

In at least one known imaging system configuration, an x-ray source projects an x-ray beam. The x-ray beam passes through an object being imaged and after being attenuated by the object, impinges upon a radiation detector. The intensity of the attenuated beam radiation received at the detector is dependent upon the attenuation of the x-ray beam by the object. The detector produces an electrical signal that is a measurement of the beam attenuation. A plurality of attenuation measurements are acquired to produce an image of the object.

The x-ray source, sometimes referred to as an x-ray tube, typically includes an evacuated glass x-ray envelope containing an anode, a control grid and a cathode. X-rays are produced by applying a high voltage across the anode and cathode and accelerating electrons from the cathode against a focal spot on the anode by applying a high voltage to the x-ray tube control grid.

At least one known imaging system includes a costly grid control power supply as a means of turning on and off the control grid voltage for controlling x-rays from the x-ray source.

It would be desirable to provide a switching unit, or circuit, which adjusts the signals applied to the x-ray source so that the magnitude and duration of the x-ray beams emitted from the x-ray tube are altered. It would also be desirable to provide a switching unit which includes any number of modular switching elements which may be combined to provide incremental control of the tube signals as required by the application while minimizing cost of the switching unit. Additionally, it would also be desirable to provide such a unit which utilizes a beam or beams of light to control the switching elements to provide isolation from the high voltage tube signals.

BRIEF SUMMARY OF THE INVENTION

These and other objects may be attained, in one embodiment, by a switching unit for altering the signals supplied to an x-ray tube to control the duration and magnitude of an x-ray beam emitted from the x-ray tube. More specifically, and in one embodiment, the switching unit controls a grid voltage of the x-ray tube so that the x-ray dosage to the patient is altered.

More particularly, and in an exemplary embodiment, the switching unit includes any number of switch elements for altering a grid bias voltage supplied to the x-ray tube, an insulating support structure for securing the modular switch elements together, and an electrostatic shield for eliminating corona discharge from the switch elements. Each switch element utilizes a beam of light excitation signal to alternate between two different modes, or states, of operation. These states of operation are sometimes referred to herein as the conduction state and the steady state. In the conduction state, if an excitation signal is received by the switch element, a switch element voltage drop across the element becomes approximately zero and a maximum signal is applied to the x-ray tube so that a maximum number of x-rays are emitted from the x-ray source. The steady state refers to the condition when an excitation signal is not received by a switch element. In the steady state, a voltage drop is generated by the switch element so that the signal applied to the x-ray tube is decreased by an amount determined by a voltage drop element.

In operation, the duration and magnitude of the x-ray beam emitted from the x-ray tube is altered by configuring each switch element in a steady state or conduction state. Specifically, by transmitting a light excitation signal to selected switch elements, the grid bias voltage supplied to the x-ray tube is altered. More specifically, by transitioning individual switch elements between the steady state and conduction state, the magnitude of the x-ray beams emitted from the x-ray tube may be incrementally altered. Particularly, and in one embodiment, the grid bias voltage is incrementally reduced so that the magnitude of the emitted x-ray beam is incrementally reduced.

In one embodiment, as a result of the modular configuration of the switching elements, the desired incremental change in the grid control voltage may be determined by combining a selected number of selected voltage drop configuration switching elements. More specifically, a switching unit is fabricated by combining any number of a switching elements, each having a specific voltage drop, in order to reduce cost and provide the proper incremental grid voltage change.

The above described switching unit controls x-ray tube signals so that the magnitude and duration of the x-ray beams emitted from the x-ray tube are altered. In addition, the switching unit includes a selectable number of switching elements to incrementally control the signals of the x-ray tube as required by the application while reducing cost of the switching unit. Further, the switching unit provides isolation from the x-ray tube high voltage signals.

DETAILED DESCRIPTION OF THE INVENTION

Figure 1:
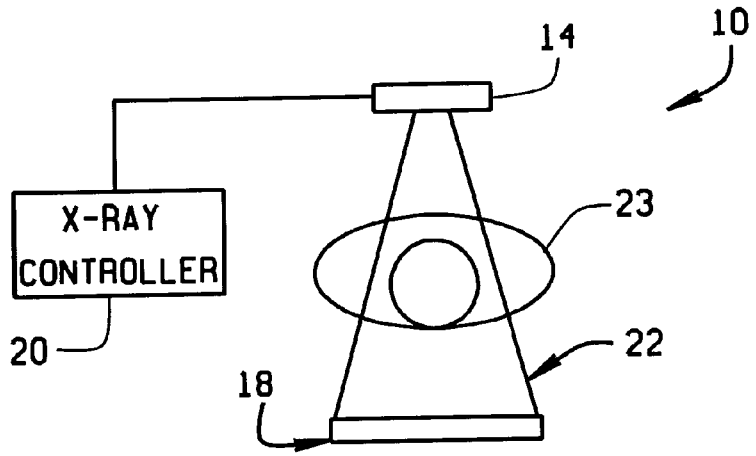
FIG. 1 is schematic diagram of an exemplary imaging system.
Figure 2:
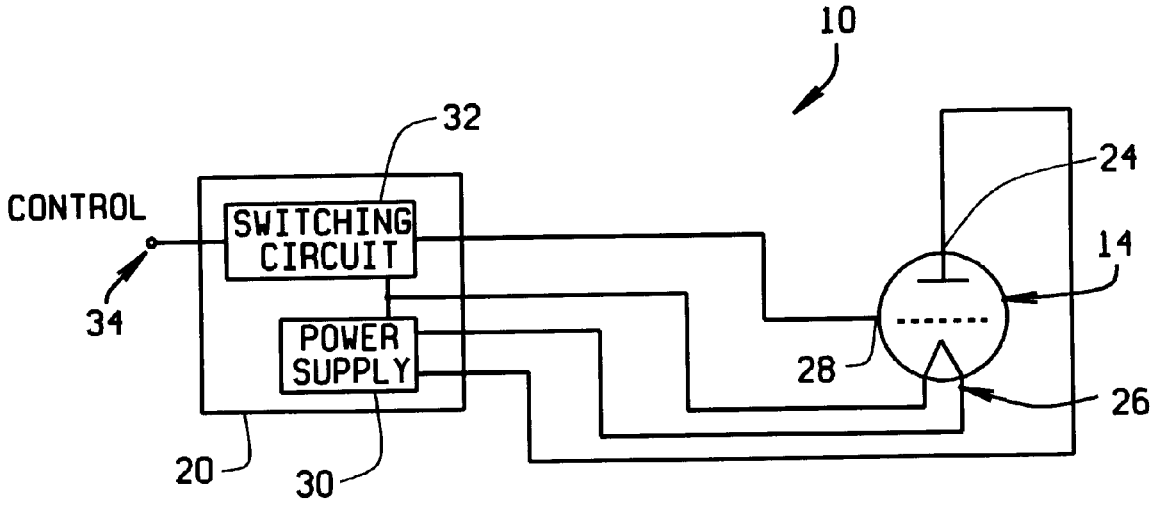
FIG. 2 is a block diagram of the imaging system of FIG. 1.

FIG. 1 is a schematic diagram of an exemplary embodiment of an x-ray imaging system 10 including an x-ray tube, or source 14, an x-ray detector 18, and an x-ray controller 20. Generally, by supplying the appropriate signals from controller 20 to tube 14, an x-ray beam 22 is radiated from tube 14 toward detector 18. In one embodiment, an object 23, for example a patient, is interposed between x-ray tube 14 and detector 18. System 10 generates an image of object 23 by determining the intensity of x-ray beam 22 at detector 18 in a manner known in the art. Particularly and referring to FIG. 2, x-ray beam 22 is radiated toward object 23 by supplying a high voltage, typically up to 150,000 volts, to an anode 24 with respect to a cathode 26 of tube 14. In one embodiment, a large negative control voltage, or bias voltage, signal is supplied to a control grid 28 of tube 14.

Adjustment of the duration and magnitude of the grid bias voltage signal alters, or adjusts, the duration and magnitude of x-ray beam 22. As a result of different imaging requirements, the duration and magnitude of x-ray beam 22 is altered so that the x-ray dosage received by object 23 is determined by the signal applied to control grid 28. For example, in order to improve the quality of the image of a patient's vascular system, the control grid signal supplied to tube 14 is altered so that the radiated x-ray energy coincides with a particular portion of a patient's heart pumping cycle.

Referring again to FIG. 2 and in one embodiment, controller 20 includes a power source means, or power supply 30 and a switching unit, or circuit 32 to alter the signals supplied to source 14. Power supply 30 is coupled to x-ray tube 14 and switching unit or means, 32 to supply signals to tube, or x-ray emitting means, 14 and unit 32. More particularly, voltage and current signals from supply 30 are supplied to anode 24 and cathode 26 of tube 14. A high voltage signal is also supplied from supply 30 to switching unit 32. Utilizing control signals 34 supplied to switching unit 32, for example, signals from a control panel source or computer (not shown), switching unit 32 alters the signals supplied to tube 14. More specifically, by altering signals 34, the signal supplied to control grid 28 of tube 14 is altered so that the speed at which the electrons travel from anode 24 to cathode 26 is modified, therefore, altering the magnitude and duration of x-ray beams 22 emitted from tube 14.

Figure 3:
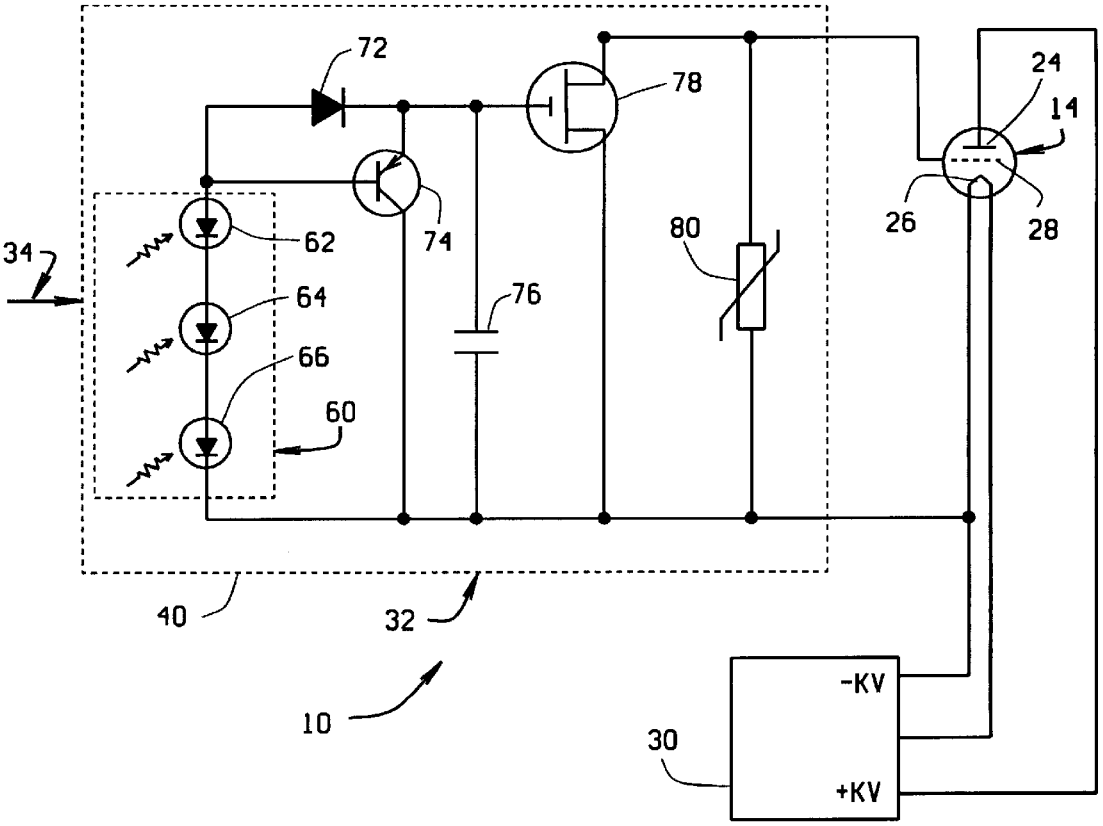
FIG. 3 is a circuit schematic diagram of a switching unit in accordance with one embodiment of the present switching unit.
Figure 4:
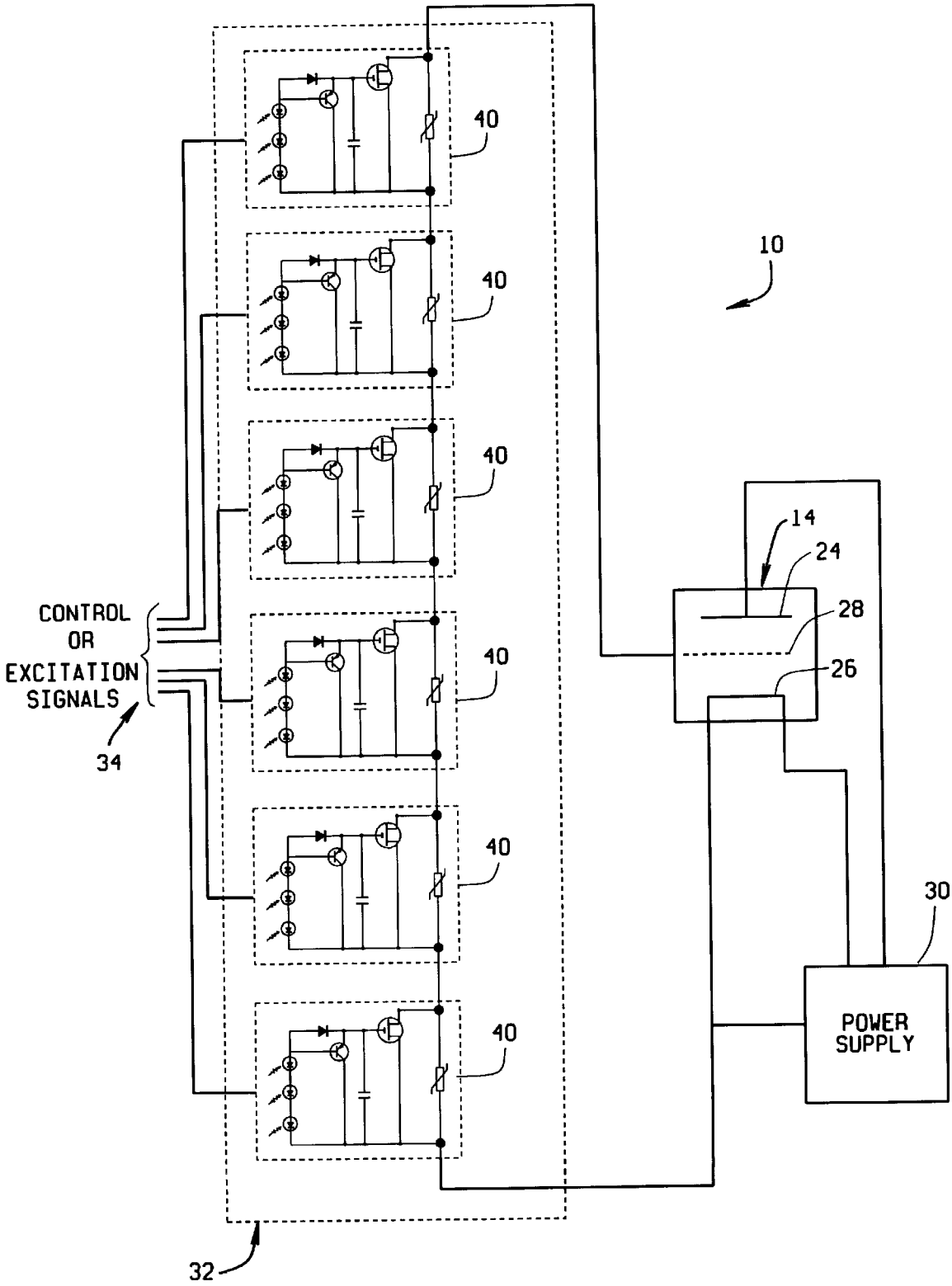
FIG. 4 is a circuit schematic diagram of a switching unit in accordance with one embodiment of the present invention.

In one embodiment and referring to FIG. 3 and 4, switching unit 32 includes at least one switching element 40 to alter the control grid voltage signal supplied to control grid 28. More specifically as shown in FIG. 3, unit 32 includes a single element 40 and as shown in FIG. 4, unit 32 includes six elements 40. Each switching element 40 includes a receiver 60 which is configured to detect an excitation, or control signal 34. For example, receiver 60 includes at least one photo-optic device 70, i.e. a opto-coupler or photodiode, for receiving a light, or illumination excitation signal 34 in order to provide isolation from the high voltage signals present within switching unit 32. Each element 40 also includes a diode 72, a transistor 74, a capacitor 76, a field effect transistor (FET) 78, and a voltage drop element, or means for generating a voltage drop 80.

Voltage drop element 80 may, for example, be a zener diode which generates a selected voltage drop. Voltage drop element 80 may, in alternative embodiments is a spark gap or any other suitable device to regulate or control the voltage across FET 78. Each voltage drop element 80 is selected to generate an appropriate voltage drop to provide incremental change to the control voltage as required by the specific application. For example, in order to control the emission of x-ray beam 22 as required, the voltage drop value of a drop element 80 of a first element 40 is 1000 volts, the voltage drop of a drop element 80 is 1000 of a second element 40, the voltage drop value of a drop element 80 of a third element 32 is 1000 volts, the voltage drop value of a drop element 80 of a fourth element 40 is 1000 volts, the voltage drop value of a drop element 80 of a fifth element 40 is 1000 volts, and the voltage drop value of a drop element 80 of a sixth element 40 is 1000 volts.

More specifically and in one embodiment of each switching element 40, receiver 60 includes photodiodes 62, 64, and 66 for receiving signal one or more of excitation signals 34. Anode of photodiode 64 is connected to cathode of photodiode 62 and anode of photodiode 66 is connected to cathode of photodiode 64. Anode of diode 72 and the base of transistor 74 are connected to receiver 70, specifically anode of photodiode 62. The junction of cathode of diode 72 and emitter of transistor 74 is connected to capacitor 76 and the gate of FET 78. The junction of receiver 70, specifically cathode of photodiode 66, the collector of transistor 74, capacitor 76, the source of FET 78 and a first end of voltage drop element 80 is connected to the junction of cathode 26 and power supply 30, for example to a −KV signal. The junction of a second end of voltage drop element 80 and the drain of FET 78 is connected to control grid 28 of source 14. A second lead of cathode 26 is connected to power supply 30. Anode 24 of tube 14 is connected to power supply 30, for example to a +KV signal.

Each element 40 has two different modes, or states of operation. These states of operation are referred to herein as the steady state and the conduction state. The steady state refers to that state of element 40 when the excitation signal 34 is not being supplied to element 40. In steady state, therefore, receiver 60 is not enabled and no current flows through receiver 60. Consequently, the voltage applied to the base of transistor 74 decreases to zero. As a result, current flows from emitter to collector of transistor 74 discharging the voltage across capacitor 76 to approximately zero. By discharging capacitor 76, the voltage applied to the gate of FET 78 is zero and current through the source and drain of FET 78 is stopped. Therefore, in the steady state, a voltage drop across element 40 is approximately equal to the voltage drop of element 80.

In the conduction state, at least one excitation signal 34 is applied to receiver 60 so that transistor 74 transitions to a non-conducting state which causes the voltage to develop sufficiently across capacitor 76. As a result, FET 78 transitions to a conducting mode, and current flows from the source to the drain of FET 78 so that the voltage drop across element 80 is approximately equal to zero. As a result, the voltage drop across element 40 is approximately equal to zero.

For example, in one embodiment where unit 32 includes a single switching element 40 having a 1,000 voltage drop element 80, in the steady state, the voltage signal supplied to control grid 28 from unit 32 is the voltage signal supplied from power supply 30 to unit 32 less the voltage drop across element 80, i.e, 1,000 volts. If, in one embodiment, the output of power supply 30 is −20,000 volts, in the steady state mode approximately −19,000 volts is supplied to control grid 28 and a voltage drop of approximately 1,000 volts exists across drop element 80. In the conduction state, the voltage drop across element 80 is approximately zero and the current flows through FET 78 so that approximately −20,000 volts is supplied to control grid 28.

In the embodiment shown in FIG. 4, switching unit 32 utilizes a plurality of switch elements 40 and excitation signals 34 so that the total voltage drop across switch unit 32 is altered to change the duration and magnitude of the x-ray beams emitted from tube 14. Specifically, each switch element may be placed in the steady state or conduction mode so that the total voltage drop varies the according to the combined value of drop elements 80.

More specifically, the desired voltage and incremental voltage step size to be supplied to tube 14 is altered by the selection of the voltage drop of each drop element 80 and the number elements 40 to meet the requirements of imaging system 10. Specifically, each switch element includes a selected voltage drop element 80. In one embodiment, unit 32 is configured so that tube 14 is transitioned between emitting x-ray beams 22 and preventing x-ray beams 22 from being emitted by simultaneously transitioning each switch element between the steady and conduction states. As a result of transitioning between these two states, the time period, or duration, of emitting x-ray beams 22 is controlled.

In addition, the magnitude of the x-ray beams transmitted by tube 14 is altered by placing less than all of switch elements 40 in the conduction mode. Specifically, the voltage and current applied to tube 14 is altered by placing at least one, but less than all, of switch element 40 in the conduction state. As a result, each switch element 40 placed in the steady state mode will generate a voltage drop so that the voltage signal supplied to control grid 28 is reduced to less than the voltage supplied from power supply 30 to unit 32.

For example, unit 32 may be configured so that the voltage drop across unit 32 is selectable between 0 and 3,875 volts in 125 volt increments. In one embodiment, three switch elements 40 each have a voltage drop element 80 of 1000 volts, one element 40 has a voltage drop element 80 of 500 volts, one element 40 has a voltage drop element 80 of 250 volts and one element 40 has a voltage drop element 80 of 125 volts. By transmitting individual excitation signals 34 to specific selected elements 40 the voltage drop of unit 32 is altered. Specifically, by transmitting an excitation signal to two switch elements 40, having drop elements of 2,000 volts, placing these elements 40 in the conduction state, a voltage drop of 1,875 volts (1,000+500+250+125 or 3,875−2,000) is generated across unit 32. As a result, the voltage signal applied to control grid 28 is the voltage signal supplied to cathode 26 from power supply 30 minus the 1,875 voltage drop across unit 32. In addition to combining any number of switch elements 40, each of switch element 40 may include a voltage drop element 80 of any size. For example, an inventory of standard switch elements 40 having different standard voltage drop elements, i.e., 1,000 volts, 500 volts, 250 volts, 125 volts, may be fabricated. By combining the proper number of each element 40, the specific requirements of an application may be achieved.

Figure 5:
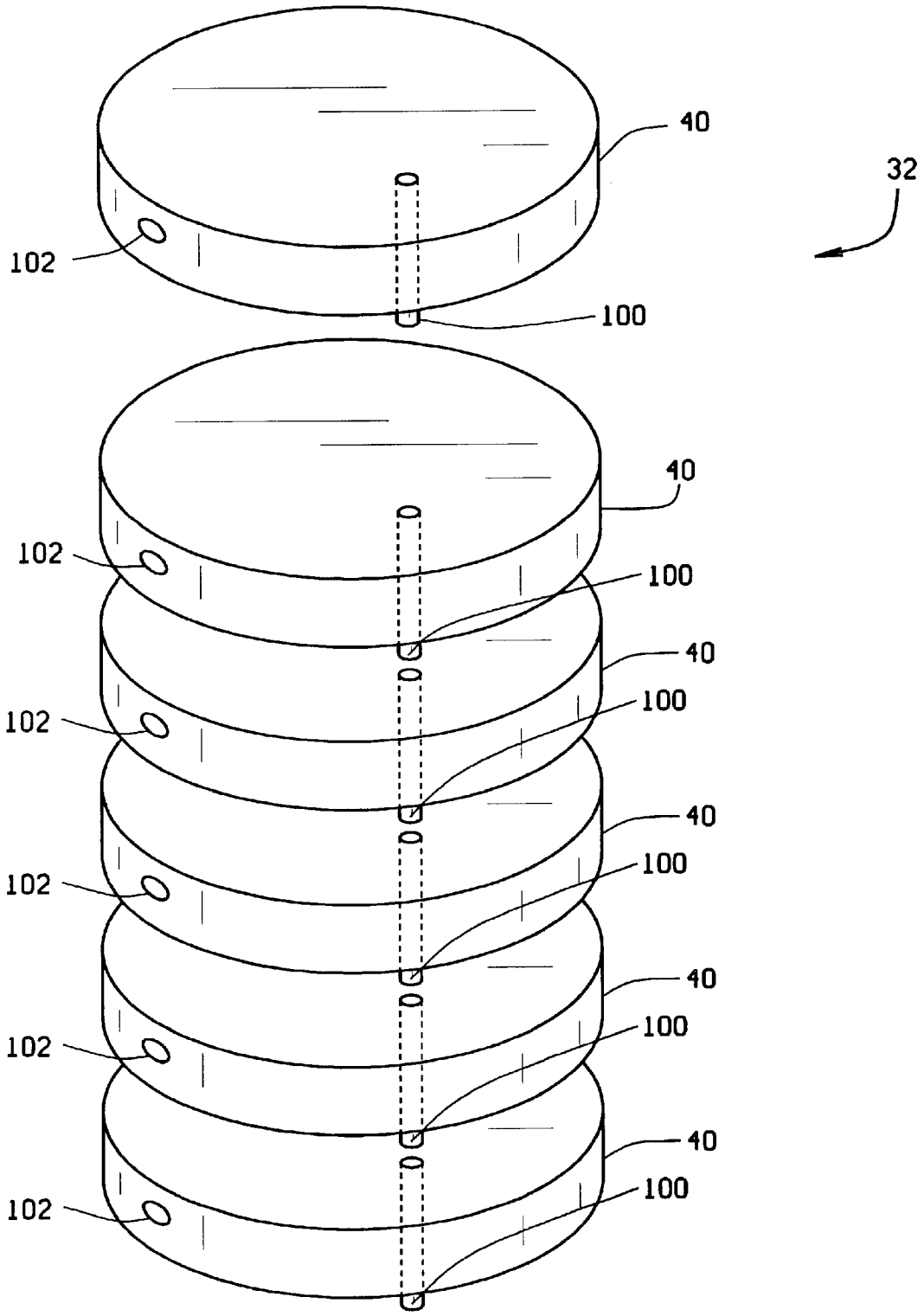
FIG. 5 illustrates the physical configuration of switching elements of FIG. 4.

More specifically and as shown in FIG. 5, elements 40, in one embodiment, are configured to interconnect with each other so that additional elements may be quickly and easily added or removed to achieve the desired total voltage drop and voltage drop increment size of unit 32. Specifically, modular switch elements 40 are coupled together utilizing intermodule connectors 100. The voltage and current signals are transmitted from unit 32 to tube 14 utilizing an external high voltage cable (not shown in FIG. 5) coupled to switch elements 40.

In one embodiment, excitation signals 34 are supplied to unit 32 utilizing signal connectors 102. In one embodiment, each signal connector 102 includes an electrical connection and an opto-coupling device (not shown). Each opto-coupling device converts a respective electrical excitation signal 34 to a light excitation signal which is transmitted to receiver 70. In alternative embodiments, connectors 102 are optical ports for receiving a light signal 34. For example, signal connectors 102 may be a lens, light pipe, or fiber optic cable.

Figure 6:
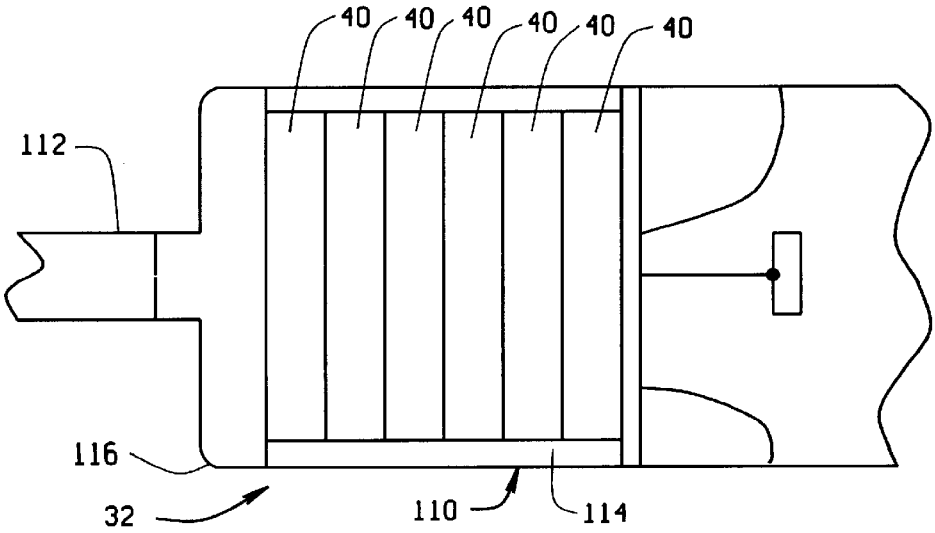
FIG. 6 illustrates the physical configuration of a switching unit in accordance with one embodiment of the pesent invention.

In one embodiment shown in FIG. 6, switch unit 32 includes an insulating support structure 110 and is coupled to power supply 30 utilizing a high voltage cable 112. Structure 110 includes an electrostatic shield 114 which is coupled to ground potential to eliminate corona discharge from switch elements 40. High voltage cable 112 includes a connector 116 that is coupled to unit 32. Specifically, connector 116 couples to intermodule connector 100.

Unit 32 is fabricating by selecting the appropriate quantity of switch elements each having the desired voltage drop element based on the voltage and current signals to be applied to tube 14. Specifically, the total voltage drop and incremental voltage drop size are utilized to determine the quantity of switch elements and the particular voltage drop element 80 for each switch element. The selected switch elements are coupled together utilizing the intermodule connectors 100 and then secured to insulating support structure 110. High voltage cable 112 is then coupled to switch elements 40 via connector 116.

In operation, after determining the desired configuration of the x-ray beams to be emitted from tube 14, the proper excitation signals 34 are transmitted to unit 32. In one embodiment, excitations signals 34 are timed so that the x-ray beams are emitted from tube 14 only when image data, or information, is being collected by system 10. After the data has been collected, excitation signals 34 are transitioned so that the excitation signals 34 are not transmitted to unit 32. Consequently, the x-ray beams are not emitted from tube 14. Utilizing unit 32, the x-ray beams are emitted only when needed and turned off when the x-ray beams are not being used to generate image data. As a result, the x-ray dosage received by patient 24 is reduced. Additionally, the magnitude of the x-ray beams emitted from tube 14 may be altered by selectively transmitting individual excitation signals 34 to unit 32 as described above.

Figure 7:
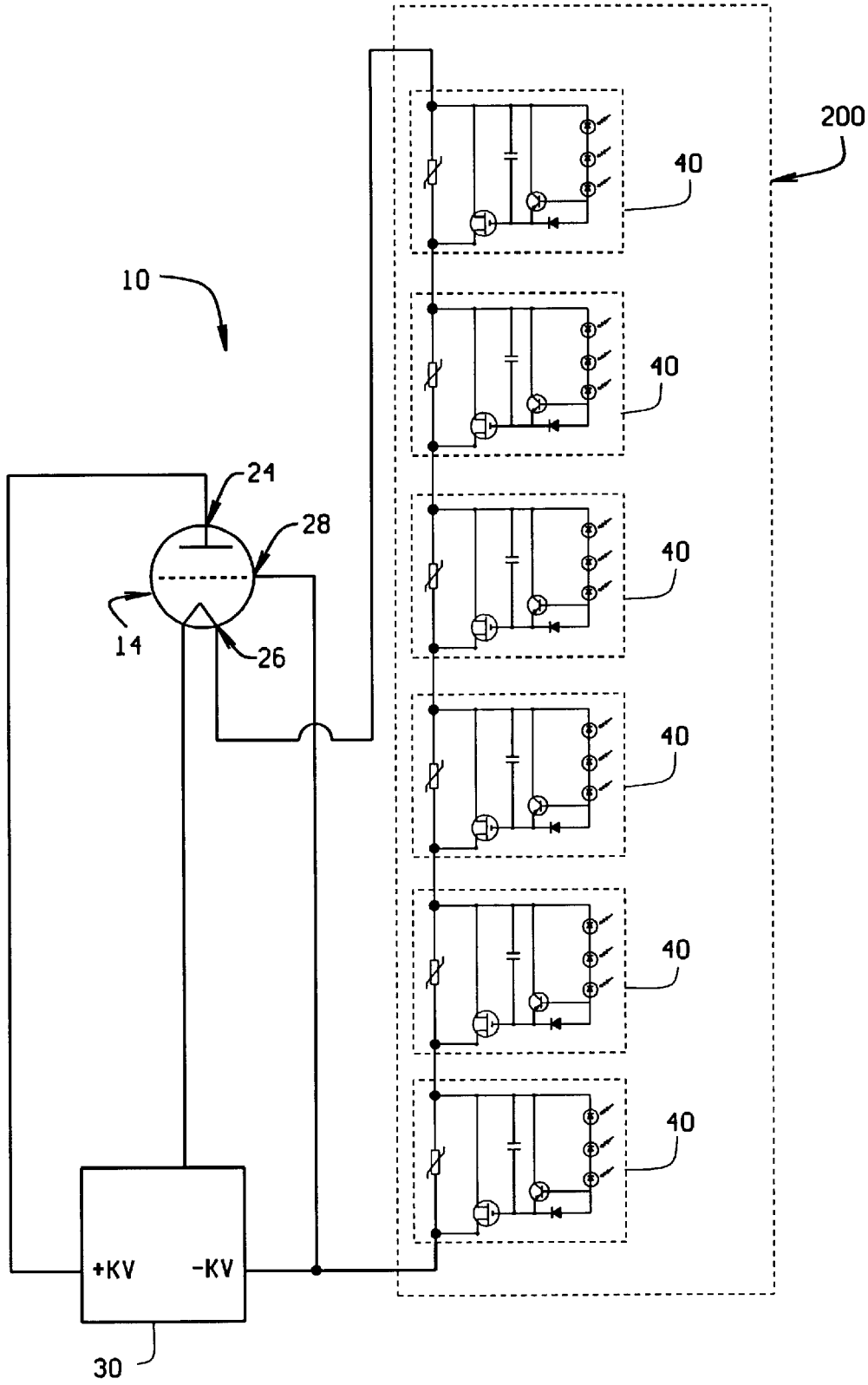
FIG. 7 is circuit schematic diagram of a switch unit in accordance with an alternative embodiment of the present invention.

In another alternative embodiment, shown in FIG. 7, unit 200 alters the duration and magnitude of the x-ray beams by altering the voltage and current signals applied to cathode 66 of tube 14. Unit 200 is identical to unit 32 as described above, except the duration and magnitude of x-ray beams emitted from tube 14 are altered by modifying the voltage and current applied to cathode 26. Specifically, by applying different excitation signals 34 to unit 200, the voltage drop across unit 200 is altered so that the voltage and current signal applied to cathode 26 is altered.

The above described switching unit controls x-ray tube signals so that the magnitude and duration of the x-ray beams emitted from the x-ray tube are altered. In addition, the switching unit includes a selectable number of switching elements to incrementally control the signals of the x-ray tube as required by the application while reducing cost of the switching unit. Further, the switching unit provides isolation from the x-ray tube high voltage signals.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, although the described switch unit includes one or more switch elements, the switch unit may also be configured to include one switch element having multiple voltage drop elements so that the duration and magnitude of the x-ray beams may be altered. Accordingly, the spirit and scope of the invention are to be limited only by the terms of the appended claims.

What is claimed is:

1. A switching unit for an imaging system, the imaging system comprising an x-ray tube and a power supply, the x-ray tube including an anode, a cathode, and a control grid, said unit comprising:

at least one switch element configured to be coupled to the x-ray tube and the power supply to alter a signal supplied to the x-ray tube to control emission of x-ray beams, each said switch element comprising at least one voltage drop element configured to alter the signal coupled to the x-ray tube so that a magnitude of the emitted x-ray beam is reduced.

2. A switching unit in accordance with claim 1 wherein each said switch element is configured to alter the signal applied to the control grid.

3. A switching unit in accordance with claim 1 wherein each said switch element is configured to alter the signal applied to the cathode.

4. A switching unit in accordance with claim 1 wherein to alter the signals to the x-ray tube, said unit is configured to:

detect whether an excitation signal is being supplied to said switch element; and if the excitation signal is being supplied to said switch element, alter the signal coupled to the x-ray tube by an amount of the voltage drop of said switch element receiving the excitation signal.

5. A switching unit in accordance with claim 4 wherein each said switch element further comprises a receiver configured to detect whether an excitation signal is being supplied to said switch element.

6. A switching unit in accordance with claim 5 wherein said receiver is a photodiode.

7. A switching unit in accordance with claim 5 wherein said receiver is an opto-coupler.

8. A switching unit in accordance with claim 1 wherein said voltage drop element is a zener diode.

9. A switching unit in accordance with claim 1 wherein said voltage drop element is a spark gap.

10. A switching unit in accordance with claim 1 further comprising an insulating structure for securing said switch elements.

11. A switching unit in accordance with claim 10 wherein said insulating structure comprises an electrostatic shield configured to reduce corona discharge from said switch elements.

12. An imaging system comprising an x-ray tube, a power supply and a switching unit coupled to said x-ray tube and said power supply, said system configured to:

determine whether x-ray beams are to be emitted from said x-ray tube; and if the x-ray beams are to be emitted, provide and alter a voltage and current signal to said x-ray tube to alter a magnitude of the x-ray beams;

and wherein said switching unit comprises at least one switch element to alter the voltage and current signal to said x-ray tube, said x-ray tube comprises an anode, cathode, and a control grid and wherein each said switch element comprises a voltage drop element having a selected voltage drop for altering the voltage and current signal supplied to said x-ray tube.

13. A system in accordance with claim 12 wherein to alter the voltage and current signal said system is configured to:

detect whether an excitation signal is being supplied to said switch element; and if the excitation signal is being supplied to said switch element, alter the voltage and current signal by the amount of the voltage drop of said switch element receiving the excitation signal.

14. A system in accordance with claim 13 wherein to alter the voltage and current signal by the amount of the voltage drop, said switching unit is configured to alter the voltage and current signal applied to said x-ray tube control grid.

15. A system in accordance with claim 13 wherein to alter the voltage and current signal by the amount of the voltage drop, said switching unit is configured to alter the voltage and current signal applied to said x-ray tube cathode.

16. A system in accordance with claim 12 wherein said voltage drop element is a zener diode.

17. A system in accordance with claim 12 wherein said voltage drop element is a spark gap.

18. A method for reducing x-ray dosage in an imaging system, the imaging system comprising an x-ray tube, a power supply and a switching unit coupled to said x-ray tube and said power supply, said method comprising the steps of:

determining whether x-ray beams are to be emitted from the x-ray tube; and if the x-ray beams are to be emitted, providing a voltage and current signal to the x-ray tube and altering the voltage and current signal to modify a magnitude of the x-ray beams;

wherein the x-ray tube comprises an anode, a cathode and a control grid and wherein each switch element comprises a voltage drop element having a selected voltage drop for altering the voltage and current signal supplied to the x-ray tube.

19. A method in accordance with claim 18 wherein altering the voltage and current signal supplied to the x-ray tube comprises the step of altering the voltage and current signal applied to the control grid by the amount of each voltage drop element.

20. A method in accordance with claim 18 wherein altering the voltage and current signal supplied to the x-ray tube comprises the step of altering the voltage and current signal applied to the x-ray tube cathode by the amount of each voltage drop element.

21. A imaging system for collecting image data of an object, said system comprising:

x-ray emitting means for emitting x-ray beams;

power source means for generating voltage and current signals; and switching means for controlling the voltage and current signals connected from said source means to said x-ray emitting means to alter at least one of a magnitude and a duration of the x-ray beams;

and wherein said switching means comprises at least one switch element having a selected voltage drop, wherein said x-ray emitting means comprises an anode, a cathode, and a control grid, and wherein to alter the signals to said x-ray emitting means said switching means is configured to:

detect whether an excitation signal is being supplied to each said switch element; and if the excitation signal is being supplied to said switch element, alter a voltage signal by the amount of voltage drop of said switch element receiving said excitation signal.

22. A system in accordance with claim 21 wherein each said switch element is configured to alter the voltage signal applied to said control grid.

23. A system in accordance with claim 21 wherein each said switch element is configured to alter the voltage signal applied to said cathode.

24. A system in accordance with claim 21 wherein said switch element comprises a zener diode for generating the voltage drop.

25. A system in accordance with claim 21 wherein said switch element comprises a spark gap for generating the voltage drop.

26. A system in accordance with claim 21 further comprising insulating structure means for securing said switch elements.

27. A system in accordance with claim 26 wherein said insulating structure means comprises an electrostatic shield configured to reduce corona discharge from said switch elements.

* * * * *